US009848461B2

(12) United States Patent
Miller

(10) Patent No.: US 9,848,461 B2
(45) Date of Patent: Dec. 19, 2017

(54) METHODS AND APPARATUS FOR THERMALLY TREATING A SUBSTRATE

(71) Applicant: APPLIED MATERIALS, INC., Santa Clara, CA (US)

(72) Inventor: Keith A. Miller, Mountain View, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 506 days.

(21) Appl. No.: 14/500,073

(22) Filed: Sep. 29, 2014

(65) Prior Publication Data

US 2016/0095166 A1 Mar. 31, 2016

(51) Int. Cl.

| | |
|---|---|
| ***H05B 1/00*** | (2006.01) |
| ***H05B 3/00*** | (2006.01) |
| ***H05B 3/04*** | (2006.01) |

(52) U.S. Cl.

CPC ..... *H05B 3/0038* (2013.01); *H05B 3/04* (2013.01)

(58) Field of Classification Search

CPC ..... H05B 3/0038; H05B 3/0047; H05B 3/04; H05B 3/68; H01L 21/324; H01L 21/681; H01L 21/67115; H01L 21/67248; H01L 21/67109; H01L 21/67173; H01L 21/67178; H01L 21/67184; H01L 21/673; H01L 21/67303; H01L 21/67448; H01L 21/67751; H01L 21/67766; F27B 5/14

See application file for complete search history.

(56) References Cited

U.S. PATENT DOCUMENTS

| | | | | |
|---|---|---|---|---|
| 6,222,161 | B1 * | 4/2001 | Shirakawa | H01L 21/67248 118/725 |
| 7,371,997 | B2 * | 5/2008 | Kobayashi | H01L 21/324 118/50.1 |
| 2015/0204606 | A1 | 7/2015 | Kutney | |

OTHER PUBLICATIONS

U.S. Appl. No. 14/788,127, filed Jun. 30, 2015, Sundararajan et al.

* cited by examiner

*Primary Examiner* — Shawntina Fuqua

(74) *Attorney, Agent, or Firm* — Moser Taboada; Alan Taboada

(57) ABSTRACT

Embodiments of methods and apparatus for thermally treating a substrate are provided herein. In some embodiments, a thermal treatment apparatus includes a chamber body including an interior volume; a plurality of substrate supports disposed within the interior volume, wherein each of the plurality of substrate supports includes a heating element; a selectively sealable opening in the chamber body sized to allow substrates to be inserted into or removed from the interior volume; a robotic arm disposed in the interior volume to move substrates onto and off of the plurality of substrate supports; and a heating assembly configured to heat substrates disposed on the robotic arm.

20 Claims, 5 Drawing Sheets

METHODS AND APPARATUS FOR THERMALLY TREATING A SUBSTRATE

FIELD

Embodiments of the present disclosure generally relate to substrate processing equipment.

BACKGROUND

Various substrate process sequences use some type of thermal treatment in addition to the deposition or etch processes that are performed on the substrate. These processes are typically performed in a vacuum environment. Such thermal treatment may be performed before or after the process. For example, a substrate may be thermally treated before processing to degas any absorbed moisture on the substrate. After processing of a substrate, the substrate may be thermally treated to anneal the processed substrate.

In many cases, standalone furnaces are used to thermally treat a substrate. However, a separate furnace is costly and occupies a large amount of valuable space in a fab. Also, the thermal treatment, for example for a degas process, takes a relatively long time due to the extensive time for moisture and residue removal to be completed. If the thermal treatment operation (before or after processing) takes longer than the process itself, the throughput of the entire system is negatively impacted.

Therefore, the inventor has provided an improved substrate heating apparatus for use with integrated fabrication systems.

SUMMARY

Embodiments of methods and apparatus for thermally treating a substrate are provided herein. In some embodiments, a thermal treatment apparatus includes a chamber body including an interior volume; a plurality of substrate supports disposed within the interior volume, wherein each of the plurality of substrate supports includes a heating element; a selectively sealable opening in the chamber body sized to allow substrates to be inserted into or removed from the interior volume; a robotic arm disposed in the interior volume to move substrates onto and off of the plurality of substrate supports; and a heating assembly configured to heat substrates disposed on the robotic arm.

In some embodiments, a substrate processing system includes: a thermal treatment apparatus as described in any of the embodiments disclosed herein; at least one substrate processing chamber; and at least one transfer robot to transfer substrates between the at least one substrate processing chamber and the thermal treatment apparatus.

In some embodiments, a method for thermally treating a substrate includes inserting a substrate into an interior volume of a thermal treatment apparatus using a transfer robot; transferring the substrate from the transfer robot to a robotic arm disposed in the interior volume; heating the substrate to a first predetermined temperature using a plurality of infrared energy sources disposed above the robotic arm; placing the substrate onto one of a plurality of substrate supports in the interior volume using the robotic arm; and heating the substrate to a second predetermined temperature using a heating element disposed in the substrate support.

In some embodiments, a thermal treatment apparatus includes a chamber body including an interior volume; a plurality of vertically aligned substrate supports disposed within the interior volume, wherein each of the plurality of substrate supports includes a heating element; a selectively sealable opening in the chamber body sized to allow substrates to be inserted into or removed from the interior volume; a robotic arm disposed in the interior volume to move substrates onto and off of the plurality of substrate supports; and a plurality of halogen lamps disposed in an upper portion of the chamber body proximate the selectively sealable opening configured to heat substrates disposed on the robotic arm.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1:
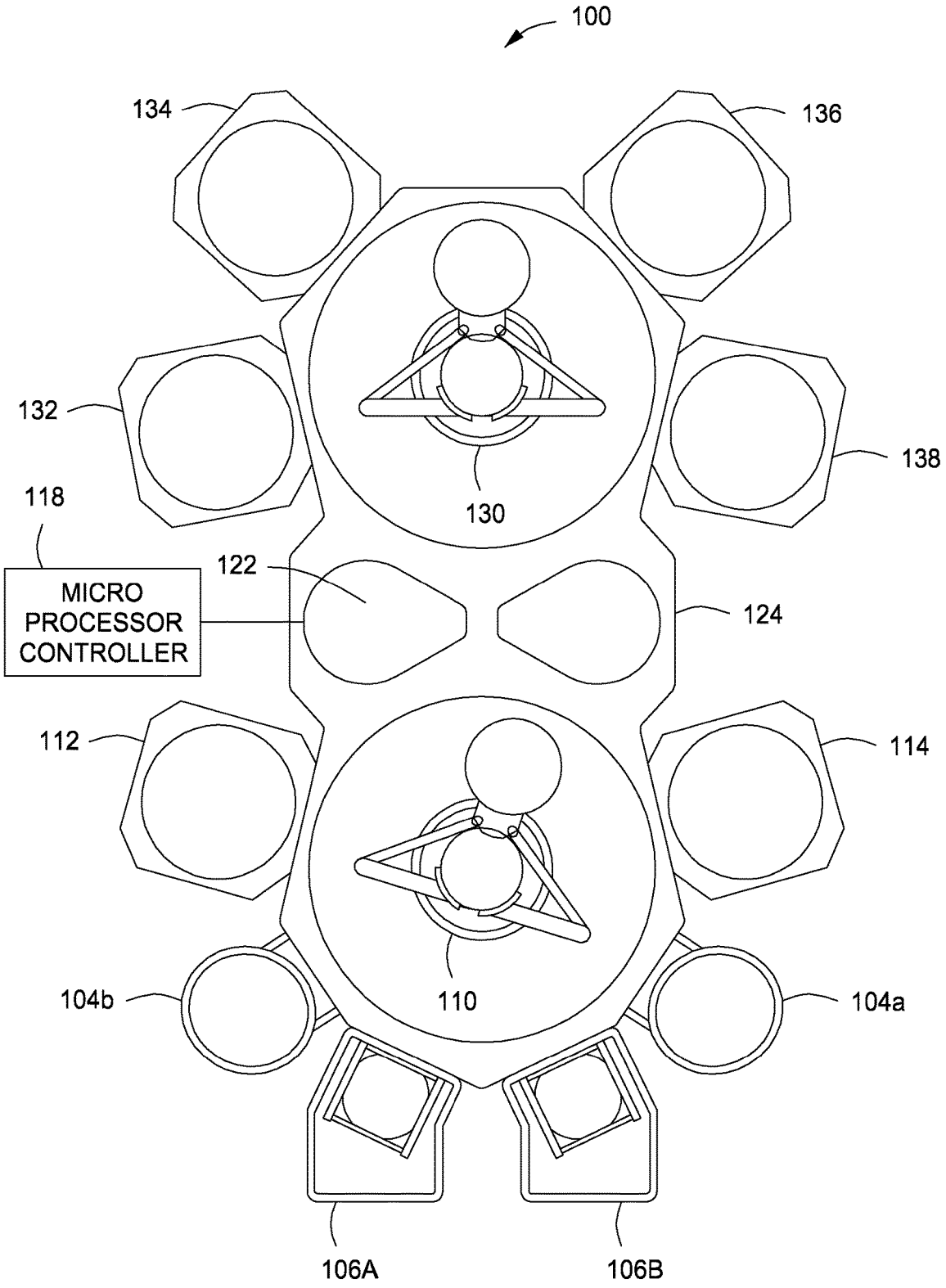
FIG. 1 is a schematic view of a processing system suitable for use with a thermal treatment apparatus in accordance with some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present disclosure generally relate to substrate thermal treatment methods and apparatus for use in integrated substrate fabrication systems. Embodiments of the inventive thermal treatment apparatus advantageously mounts directly to a cluster tool including at least one processing chamber, thus increasing throughput of the cluster tool while minimizing any negative impact on the floor space occupied by the cluster tool.

FIG. 1 is a schematic top-view diagram of an exemplary cluster tool 100 (i.e., a substrate processing system) that may be suitable for use with the present inventive apparatus disclosed herein. The cluster tool 100 features at least one substrate processing chamber (e.g., a physical vapor deposition (PVD) chamber) 102 and at least one thermal treatment apparatus 104 (two shown in FIG. 1: 104*a*, 104*b*), as described below. Examples of the integrated cluster tool 100 include the ENDURA® integrated tool, available from Applied Materials, Inc., of Santa Clara, Calif. It is contemplated that the methods described herein may be practiced using other cluster tools having suitable process chambers coupled thereto, or in other suitable process chambers. For example, it may be advantageous in some embodiments, to perform the inventive methods discussed above in an integrated tool such that there are limited or no vacuum breaks between processing steps. For example, reduced vacuum breaks may limit or prevent contamination between layers or other portions of the substrate.

The cluster tool 100 can include one or more load lock chambers 106A, 106B for transferring of substrates into and out of the cluster tool 100 and a controller 118. Typically, since the cluster tool 100 is under vacuum, the load lock chambers 106A, 106B may "pump down" the substrates introduced into the cluster tool 100. A first transfer robot 110 may transfer the substrates between the load lock chambers 106A, 106B, and a first set of one or more substrate processing chambers 112, 114 (2 are shown). Each substrate processing chamber 112, 114 can be outfitted to perform a number of substrate processing operations including the physical vapor deposition processes described herein in addition to, atomic layer deposition (ALD), chemical vapor deposition (CVD), pre-clean, thermal process/degas, orientation and other substrate processes. In some embodiments, at least one of the substrate processing chambers 112, 114 may be replaced with a cool-down station after the substrate is heated in the thermal treatment apparatus 104 and before returning to an atmospheric environment. In some embodiments, the intermediate transfer chambers 122, 124 may include low temperature substrate supports on which a heated substrate is placed to cool down.

The first transfer robot 110 can also transfer substrates to/from one or more intermediate transfer chambers 122, 124. The intermediate transfer chambers 122, 124 can be used to maintain ultrahigh vacuum conditions while allowing substrates to be transferred within the cluster tool 100. A second transfer robot 130 can transfer the substrates between the intermediate transfer chambers 122, 124 and a second set of one or more substrate processing chambers 132, 134, 136, and 138. Similar to substrate processing chambers 112, 114, the substrate processing chambers 132, 134, 136, 138 can be outfitted to perform a variety of substrate processing operations including the physical vapor deposition processes described herein in addition to atomic layer deposition (ALD), chemical vapor deposition (CVD), pre-clean, thermal process/degas, and orientation, for example. Any of the substrate processing chambers 112, 114, 132, 134, 136, 138 may be removed from the cluster tool 100 if not necessary for a particular process to be performed by the cluster tool 100.

Figure 2:
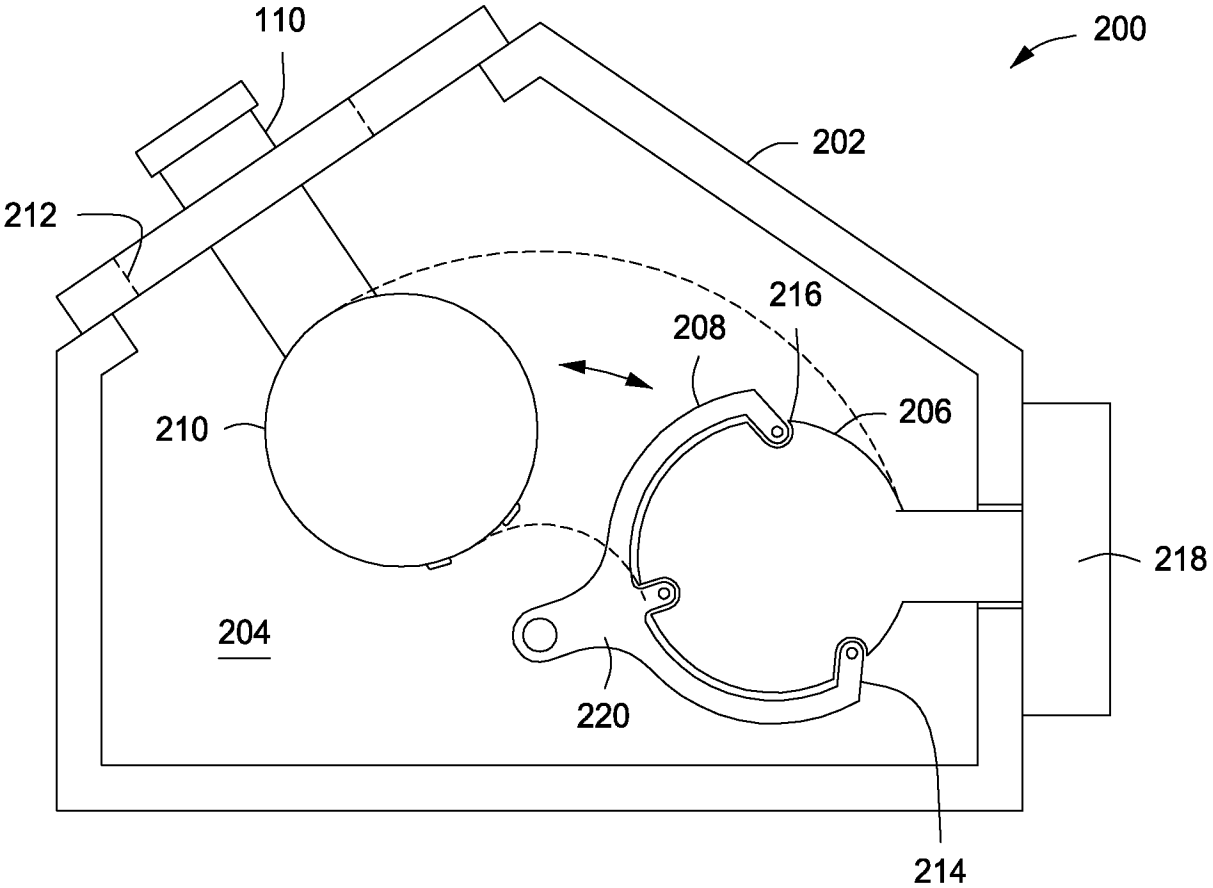
FIG. 2 is a schematic top view of a thermal treatment apparatus in accordance with some embodiments of the present disclosure.
Figure 3:
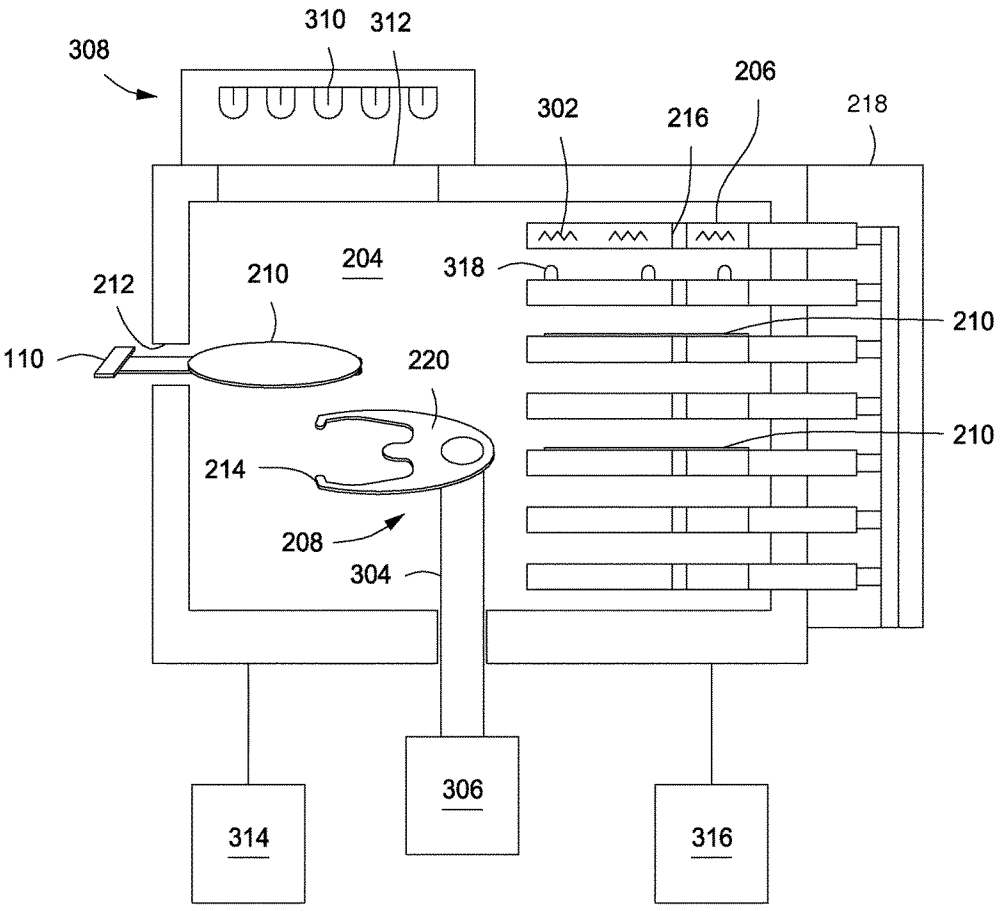
FIG. 3 is a schematic side view of a thermal treatment apparatus in accordance with some embodiments of the present disclosure.

FIGS. 2 and 3 illustrate a schematic top view and a schematic side view, respectively, of a thermal treatment apparatus 200 according to some embodiments of the present disclosure. The thermal treatment apparatus 200 includes a chamber body 202 including an interior volume 204, a plurality of substrate supports 206 (6 shown in FIG. 3), and a robotic arm 208. In some embodiments, the plurality of substrate supports 206 are vertically aligned to save space. Each of the plurality of substrate supports 206 has a thickness of about 0.5 inches to about 1.5 inches and may be formed of any suitable material, such as, for example, stainless steel. The specific number of substrate supports 206 depends on the throughput of the cluster tool 100.

The chamber body 202 further includes a selectively sealable opening 212 (e.g., a slit valve) to allow for the transfer of a substrate 210 to/from the thermal treatment apparatus 200. The robotic arm 208 includes a support arm 220 having a plurality of prongs 214 to support the substrate 210 atop the robotic arm. Each of the plurality of substrate supports 206 includes a plurality of notches 216 that correspond to the plurality of prongs 214 of the robotic arm 208.

Each of the plurality of substrate supports 206 includes a heating element 302 to heat a substrate 210 disposed on the substrate support 206. An electric box 218 is electrically coupled to the heating element 302 disposed in each of the plurality of substrate supports 206 to provide power to the heating element 302. The heating element 302 may be any suitable heater, such as a resistive heater or the like, and may comprise a single heating element or a plurality of heating elements disposed in a plurality of independently controlled heater zones.

Referring to FIG. 3, the support arm 220 of the robotic arm 208 is coupled to a shaft 304. The shaft 304 is coupled to an actuator 306 at an end opposite the support arm 220 to lift and rotate the robotic arm 208 as desired.

Figure 4:
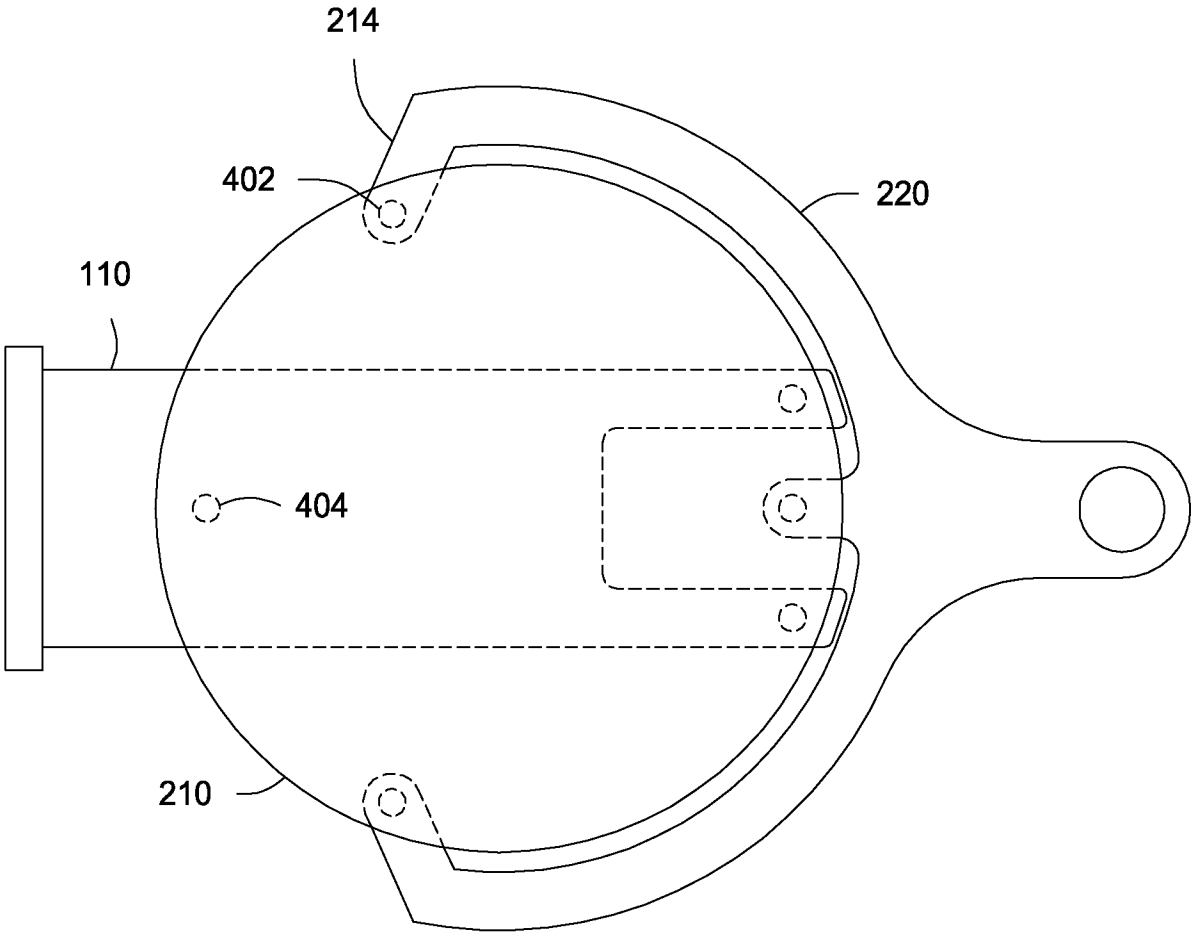
FIG. 4 is a schematic top view of a robotic arm suitable for use with a thermal treatment apparatus in accordance with some embodiments of the present disclosure.

FIG. 4 depicts schematic view of the interface between the transfer robot 110 and the support arm 220 according to some embodiments of the present disclosure. In order to facilitate the handoff of the substrate 210 from the transfer robot 110 to the robotic arm 208, the robotic arm support arm 220 has a shape that interfaces with the transfer robot 110. The support arm 220 includes a plurality of contact elements 402 to contact a backside of the substrate 210. The plurality of contact elements 402 are formed of a material that substantially prevents damage to the substrate 210 upon contact. In some embodiments, the plurality of contact elements 402 may be sapphire balls. The transfer robot 110 may similarly have a plurality of contact elements 404.

Returning to FIG. 3, the thermal treatment apparatus 200 also includes a heating assembly 308 disposed proximate to the selectively sealable opening 212. The heating assembly 308 includes a plurality of infrared energy sources 310 disposed above a window 312. The infrared energy sources 310 may be any suitable infrared energy source, such as a plurality of halogen lamps or the like. The window 312 may be formed of any suitable material, such as, for example, quartz.

In operation, the transfer robot 110 extends through the selectively sealable opening 212 to transfer a substrate 210 to the thermal treatment apparatus 200. The robotic arm 208 receives the substrate 210 from the transfer robot 110. After the substrate 210 is placed on the robotic arm 208, the actuator 306 adjusts the height of the support arm 220 to a height corresponding to the desired substrate support 206. The robotic arm 208 is then rotated so that the support arm 220 with the substrate 210 lies above the desired substrate support 206. The robotic arm 208 is then lowered so that the prongs 214 pass through the notches 216 allowing the support arm 220 to be lowered below and the substrate 210 to rest on the substrate support 206. In some embodiments, each of the plurality of substrate supports 206 may include a plurality of contact elements 318 to contact a backside of the substrate 210. The contact elements 318 may be formed of any suitable material to prevent damage to the substrate 210 upon contact. For example, the contact elements 318 may include sapphire balls. After the substrate 210 has been placed on one of the plurality of substrate supports 206, the electric box 218 energizes the heating element 302 to heat the substrate 210.

In some embodiments, the thermal treatment apparatus 200 may include a purge gas source 314 to supply purge gas to the interior volume 204 and a vacuum pump 316 to maintain the interior volume at vacuum. The window 312 has a thickness sufficient to ensure that the window 312 does not buckle under the vacuum pressure in the interior volume 204. For example, the window 312 may have a thickness of about 1 inch.

Figure 5:
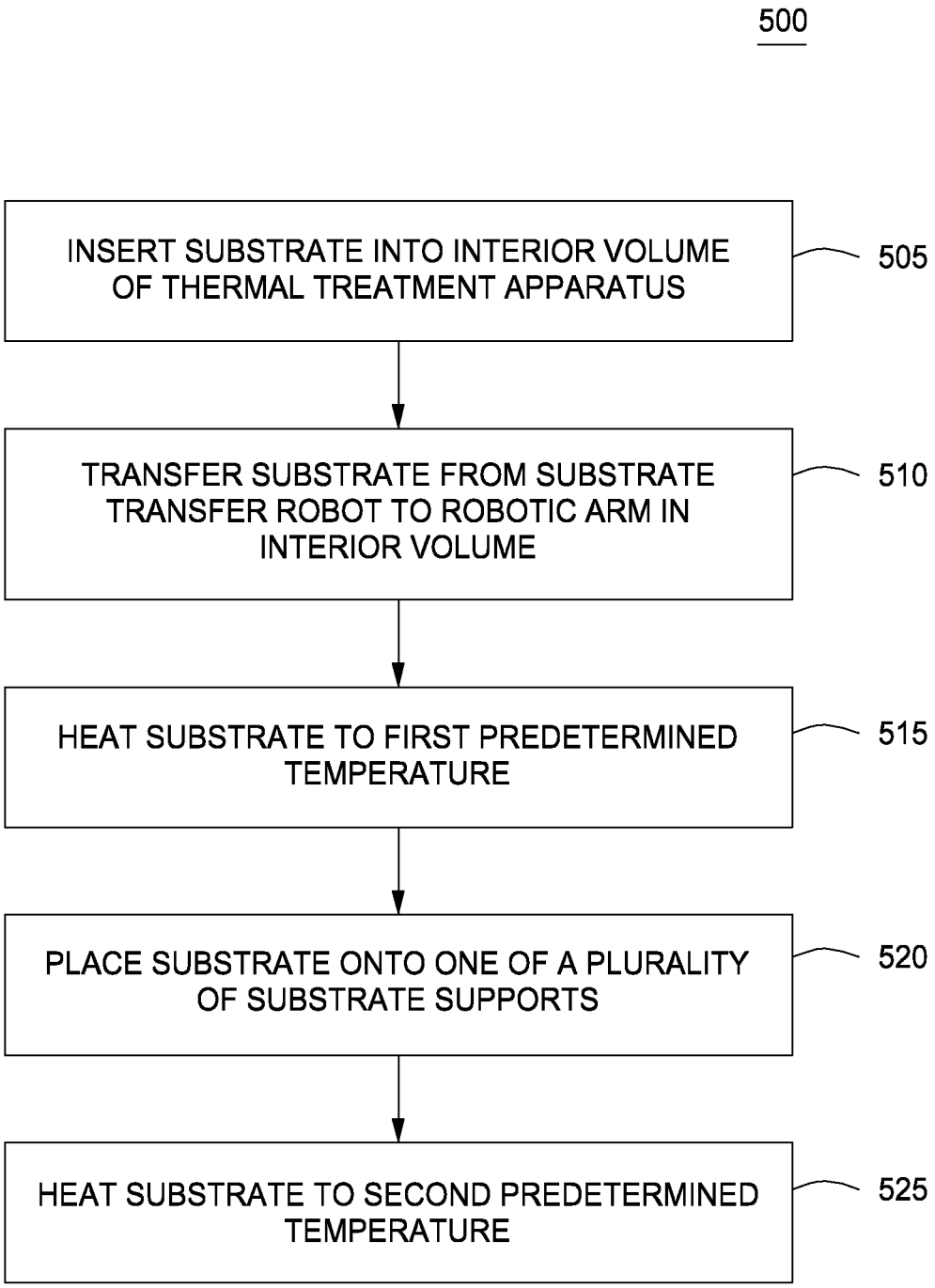
FIG. 5 is a flow chart illustrating a method of thermally treating a substrate in accordance with some embodiments of the present disclosure.

FIG. 5 depicts a flow chart illustrating a method 500 of thermally treating a substrate according to some embodiments of the present disclosure. At 505, the substrate 210 is inserted into the interior volume 204 of the thermal treatment apparatus 200 using the transfer robot 110. The substrate 210 may be inserted into the thermal treatment apparatus 200 before processing to perform a degas process and/or after processing to perform an anneal process. The degas process removes moisture from the substrate 210. The anneal process changes the properties of films deposited on the substrate 210 during processing. At 510, the substrate 210 is transferred from the transfer robot 110 to the robotic arm 208 disposed in the interior volume 204.

At 515, the substrate 210 is heated to a first predetermined temperature using the plurality of infrared energy sources 310 disposed above the robotic arm 208. The substrate 210 is heated to the first predetermined temperature while it rests on the robotic arm 208. At 520, the substrate 210 is placed onto one of the plurality of substrate supports 206 after the substrate 210 has reached the first predetermined temperature. At 525, the substrate 210 is heated to a second predetermined temperature using the heating element 302 disposed in the substrate support 206. The first and second predetermined temperatures are selected based on the process or processes being performed in the cluster tool 100 and the thermal treatment being performed in the thermal treatment apparatus 200 (i.e., degas or anneal). The first predetermined temperature may be greater than or equal to the second predetermined temperature. In some embodiments, the first and second predetermined temperatures are between about 100° C. to about 500° C.

The substrate 210 is preheated by radiation using the plurality of infrared energy sources 310 prior to contacting the substrate support 206 to prevent any deformation of the substrate 210 caused by contacting the high temperature substrate support 206. The substrate support 206 maintains the substrate 210 at the second predetermined temperature for a predetermined period of time necessary to achieve the desired result of the process being performed in the thermal treatment apparatus 200.

Returning to FIG. 1, the controller 118 comprises a central processing unit (CPU), a memory, and support circuits for the CPU and facilitates control of the components of the cluster tool 100 and, as such, of methods of thermally treating a substrate, such as discussed herein. The controller 118 may be one of any form of general-purpose computer processor that can be used in an industrial setting for controlling various chambers and sub-processors. The memory, or computer-readable medium, of the CPU may be one or more of readily available memory such as random access memory (RAM), read only memory (ROM), floppy disk, hard disk, or any other form of digital storage, local or remote. The support circuits are coupled to the CPU for supporting the processor in a conventional manner. These circuits include cache, power supplies, clock circuits, input/output circuitry and subsystems, and the like. The memory stores software (source or object code) that may be executed or invoked to control the operation of the cluster tool 100 in the manner described above. The software routine may also be stored and/or executed by a second CPU (not shown) that is remotely located from the hardware being controlled by the CPU.

While the foregoing is directed to embodiments of the present disclosure, other and further embodiments of the disclosure may be devised without departing from the basic scope thereof.

The invention claimed is:

1. A thermal treatment apparatus, comprising:

a chamber body including an interior volume;

a plurality of substrate supports disposed within the interior volume, wherein each of the plurality of substrate supports includes a heating element;

a selectively sealable opening in the chamber body sized to allow substrates to be inserted into or removed from the interior volume;

a robotic arm disposed in the interior volume to move substrates onto and off of the plurality of substrate supports and to transfer, within the interior volume, substrates to and from a transfer robot disposed outside of the interior volume; and a heating assembly, configured to heat substrates disposed on the robotic arm.

2. The thermal treatment apparatus of claim 1, further comprising:

a vacuum pump coupled to the interior volume of the chamber body.

3. The thermal treatment apparatus of claim 1, further comprising:

a purge gas source coupled to the interior volume of the chamber body.

4. The thermal treatment apparatus of claim 1, wherein the heating assembly comprises:

a plurality of infrared energy sources.

5. The thermal treatment apparatus of claim 4, wherein the plurality of infrared energy sources are halogen lamps.

6. The thermal treatment apparatus of claim 1, wherein the plurality of substrate supports are vertically aligned.

7. The thermal treatment apparatus of claim 1, wherein each of the plurality of substrate supports has a thickness of about 0.5 inches to about 1.5 inches.

8. The thermal treatment apparatus of claim 1, wherein the heating element is configured to provide energy sufficient to maintain a substrate at a temperature of about 100° C. to about 500° C.

9. The thermal treatment apparatus of claim 1, wherein the heating assembly is configured to provide energy sufficient to heat a substrate to a temperature of about 100° C. to about 500° C.

10. The thermal treatment apparatus of claim 1, wherein the robotic arm and the plurality of substrate supports include a plurality of contact elements to contact a backside of the substrate when placed thereon.

11. The thermal treatment apparatus of claim 1, further comprising:

a window disposed in an upper portion of the chamber body proximate the selectively sealable opening.

12. The thermal treatment apparatus of claim 11, wherein the window is formed of quartz.

13. The thermal treatment apparatus of claim 1, wherein each of the plurality of substrate supports includes a plurality of independently controlled heater zones.

14. The thermal treatment apparatus of claim 1, wherein the robotic arm comprises:

a shaft coupled to an actuator configured to lift and rotate the shaft; and a support arm having a plurality of prongs to support a substrate thereon.

15. The thermal treatment apparatus of claim 14, wherein each of the plurality of substrate supports includes plurality of notches corresponding to the plurality of prongs.

16. A substrate processing system, comprising:

the thermal treatment apparatus of claim 1;

at least one substrate processing chamber; and a transfer robot to transfer substrates between the at least one substrate processing chamber and the thermal treatment apparatus, wherein the transfer robot is configured to extend into the chamber body of the thermal treatment apparatus to perform substrate transfer operations with the robotic arm within the chamber body.

17. The substrate processing system of claim 16, wherein the robotic arm has a support arm having a shape that interfaces with a shape of the transfer robot.

18. A method for thermally treating a substrate, comprising:

inserting a substrate into an interior volume of a thermal treatment apparatus using a transfer robot;

transferring the substrate from the transfer robot to a robotic arm disposed in the interior volume;

heating the substrate to a first predetermined temperature using a plurality of infrared energy sources disposed above the robotic arm;

placing the substrate onto one of a plurality of substrate supports in the interior volume using the robotic arm; and heating the substrate to a second predetermined temperature using a heating element disposed in the substrate support.

19. The method of claim 18, further comprising:

maintaining the substrate at the second predetermined temperature for a predetermined period of time, wherein the second predetermined temperature is greater than or equal to the first predetermined temperature.

20. A thermal treatment apparatus, comprising:

a chamber body including an interior volume;

a plurality of vertically aligned substrate supports disposed within the interior volume to support a corresponding plurality of substrates, wherein each of the plurality of substrate supports includes a heating element;

a selectively sealable opening in the chamber body sized to allow substrates to be inserted into or removed from the interior volume;

a robotic arm disposed in the interior volume to move substrates onto and off of the plurality of substrate supports; and a plurality of halogen lamps disposed in an upper portion of the chamber body proximate the selectively sealable opening configured to heat substrates disposed on the robotic arm.

* * * * *